United States Patent [19]

Holme

[11] 4,047,693

[45] Sept. 13, 1977

[54] SUPPORTING RING FOR USE IN THE CASTING OF CONCRETE PIPES

[75] Inventor: Bent Melchior Karlsen Holme, Bronderslev, Denmark

[73] Assignee: Pedershaab Maskinfabrik A/S, Bronderslev, Denmark

[21] Appl. No.: 648,539

[22] Filed: Jan. 12, 1976

[30] Foreign Application Priority Data

Feb. 21, 1975 Denmark ..... 676/75

[51] Int. Cl.[2] ..... B28B 21/76

[52] U.S. Cl. ..... 249/187 R; 249/100; 425/470; 425/DIG. 117

[58] Field of Search ..... 425/262, 470, DIG. 117; 249/100, 144, 187, 188, 146–148, 150–153

[56] References Cited

U.S. PATENT DOCUMENTS

| | | | |
|---|---|---|---|
| 2,321,277 | 6/1943 | Boyle | 425/85 |
| 3,141,223 | 7/1964 | Steiro | 249/100 |
| 3,276,091 | 10/1966 | Pausch | 249/100 |

FOREIGN PATENT DOCUMENTS

| | | | |
|---|---|---|---|
| 1,226,474 | 10/1966 | Germany | 249/100 |
| 1,952,377 | 4/1971 | Germany | 249/152 |
| 1,957,737 | 5/1971 | Germany | 425/262 |

*Primary Examiner*—Ronald J. Shore
*Assistant Examiner*—John McQuade
*Attorney, Agent, or Firm*—Owen, Wickersham & Erickson

[57] ABSTRACT

A supporting ring for casting machines for concrete pipes for use in moulding the socket end of the pipe and as a base for the green pipe during the removal of the casting mould and the initial hardening of the concrete, said ring consisting of a hollow annular body of a closed, preferably substantially rectangular cross-section.

1 Claim, 2 Drawing Figures

SUPPORTING RING FOR USE IN THE CASTING OF CONCRETE PIPES

BACKGROUND OF THE INVENTION

This invention relates to a supporting ring for casting machines for concrete pipes for use in moulding the socket end of the pipe and as a base for the green pipe during the removal of the casting mould and at rate during the initial hardening process, said supporting ring consisting of an annular body comprising a lower flange, which projects laterally, for the moulding of the end face of the socket and a substantially plane top for moulding the end face of the pipe body inside to socket.

BRIEF SUMMARY OF THE INVENTION

Supporting rings of the kind mentioned above are known which are manufactured in various ways depending on their size, that is to say depending on the dimensions of the concrete pipes for which they are to be used, but to all supporting rings it applies that in order to fulfil the demands put to the internal dimensions of the socket end they must be manufactured with a high dimensionl accuracy and must be able to preserve this accuracy even when used repeatedly.

By way of example, supporting rings for smaller pipe dimensions are manufactued of drawn, preferably deep-drawn plate, whereas supporting rings for large pipe dimensions cannot be manufactured by deep-drawing since deep-drawn plate is not obtainable in thicknesses larger than about 6 mm, and consequently deep-drawn supporting rings are not suited for larger pipe dimensions due to lack of rigidity and strength. For this purpose are instead used supporting rings manufactured by casting of iron or aluminium or fabricated from steel by welding. Cast or welded supporting rings are heavy and unwieldy and require an additional machining to the final dimensions, and this makes their manufacture more expensive.

It is an oject of the invention to provide a supporting ring without the drawbacks of the prior art supporting rings, and the invention provides a supporting ring of the type referred to above which is characterized in that the annular body is hollow and of a closed, preferably substantially rectangular cross-section.

The supporting ring according to the invention is distinguished by being rigid and strong like the prior art cast or welded supporting rings, but nevertheless of a comparatively small weight like the first-mentioned deep-drawn supporting rings — also for large pipe dimensions.

The supporting ring according to the invention can be manufactured in a simple and inexpensive way, particularly in the case of mass production, if it consists of two rings of approximately Z-shaped cross-section which are produced by drawing, preferably deep-drawing, of plate and which are joined by welding close to the edges of the head and foot of the Z-shape.

DETAILED DESCRIPTION

Figure 1:
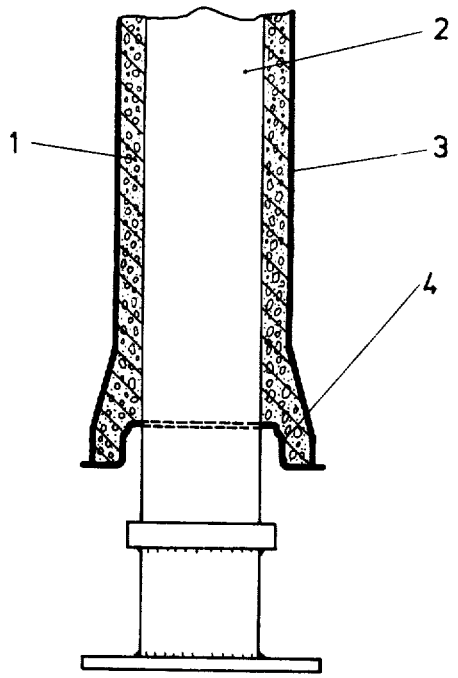
FIG. 1 is a partially sectioned elevation view of part of a casting machine for concrete pipes for illustrating the use of one of the prior art supporting rings for moulding the socket end of a concrete pipe.

As shown in FIG. 1, a concrete pipe 1 is manufactured around a core 2 containing a vibrator and inside a mould comprising a mantle 3, which defines the outer dimensions of the pipe body, and a supporting ring 4 for moulding the inside of the socket end of the pipe.

When the mould is to be removed from the pipe, the mantle 3 and the core 2 are removed, while the supporting ring 4 is left for supporting the pipe during its transport from the casting machine and at any rate during part of the hardening time.

Figure 2:
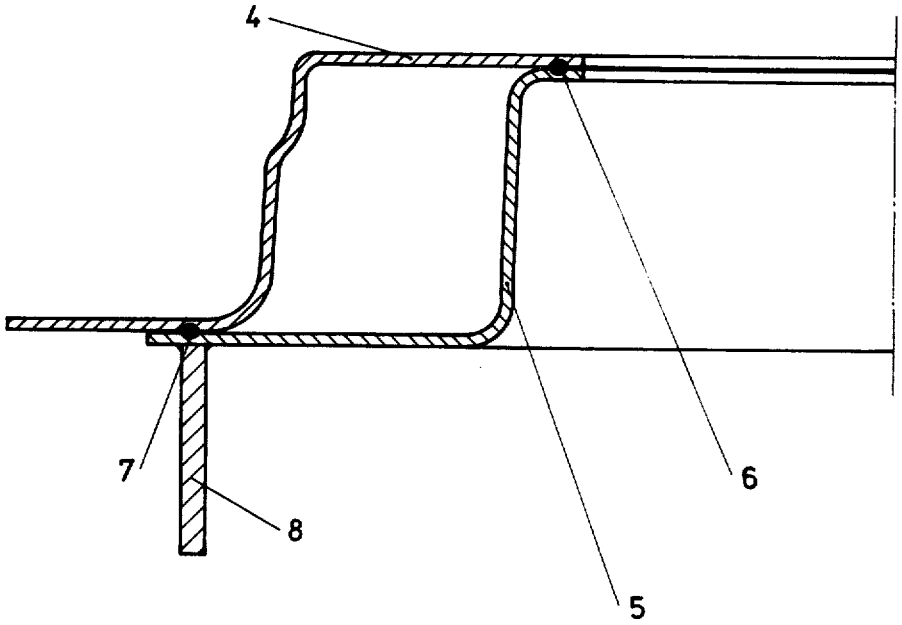
FIG. 2 shows a cross-section of a supporting ring according to the invention.

A supporting ring, which is sifficiently rigid and strong for being able to support the concrete pipe after the removal from the mould and can withstand being engaged by e.g. the forks of a fork lift, also in the case of large pipe dimensions, may according to the invention have a configuration as showin in FIG. 2.

This figure shows a supporting ring 4 which has been deep-drawn of plate so as to have an approximately Z-shaped cross-section and which resembles the prior art deep-drawn supporting rings for smaller pipes.

The supporting ring 4 is, however, strengthened by means of another substantially Z-shped, deep-drawn ring 5 which with its head and foot is welded onto the head and foot (at 6 and 7), respectively, of the supporting ring.

Together the two rings form a hollow annular body of a substantially rectangular cross-section which relative to its mass is strong and rigid.

The supporting ring shown rests on legs 8 which are welded thereon and permits access for e.g. the forks of a fork left.

I claim:

1. A supporting ring for casting machines for concrete pipes for use in moulding the socket end of the pipe and as a base for the green pipe during the removal of the casting mould and during the initial hardening of the concrete and transport of the green pipe, said supporting ring being formed by an annular body having a hollow portion of generally rectangular cross-section and comprising two rings of approximately Z-shaped cross-section, one Z-shaped ring being formed by a lower flange which projects laterally outwardly from the hollow portion for the moulding of the end face of the socket, a substantially plane top spaced from the lower flange for moulding of the end face of the pipe body inside the socket and wall means connecting the lower flange and the plane top, and the other Z-shaped ring having corresponding and generally parallel components including a bottom flange and a top flange welded to the lower flange and the plane top, respectively, said Z-shaped rings being produced from sheet metal.

* * * * *